US007266911B2

(12) United States Patent
Holzer et al.

(10) Patent No.: US 7,266,911 B2
(45) Date of Patent: Sep. 11, 2007

(54) LACING SYSTEM FOR A SHOE

(75) Inventors: Helmut Holzer, St. Johann (AT); Gerhard Trinkaus, Köflach (AT)

(73) Assignee: ATOMIC Austria GmbH, Altenmarkt im Pongau (AT)

( * ) Notice: Subject to any disclaimer, the term of this patent is extended or adjusted under 35 U.S.C. 154(b) by 552 days.

(21) Appl. No.: 10/941,218

(22) Filed: Sep. 15, 2004

(65) Prior Publication Data

US 2005/0060912 A1 Mar. 24, 2005

(30) Foreign Application Priority Data

Sep. 18, 2003 (AT) ..... A 1471/2003

(51) Int. Cl.
*A43C 11/00* (2006.01)

(52) U.S. Cl. ..... 36/50.1; 36/50.1; 36/10

(58) Field of Classification Search ..... 36/50.1, 36/10

See application file for complete search history.

(56) References Cited

U.S. PATENT DOCUMENTS 4,517,753 A * 5/1985 Rosenbaum et al. ..... 36/128
4,622,763 A * 11/1986 Adams ..... 36/50.1
5,214,863 A * 6/1993 Skaja ..... 36/50.1
5,345,697 A * 9/1994 Quellais ..... 36/50.1
5,349,764 A * 9/1994 Posner ..... 36/50.1
5,537,763 A * 7/1996 Donnadieu et al. ..... 36/50.1
6,073,370 A * 6/2000 Okajima ..... 36/50.1
6,993,859 B2 * 2/2006 Martin et al. ..... 36/50.5
2002/0083621 A1 * 7/2002 Durocher ..... 36/50.5
2002/0144434 A1 * 10/2002 Farys et al. ..... 36/54
2004/0078999 A1 * 4/2004 Freed ..... 36/50.1

FOREIGN PATENT DOCUMENTS

EP 0 398 303 5/1990

* cited by examiner

*Primary Examiner*—Marie Patterson
(74) *Attorney, Agent, or Firm*—Collard & Roe, P.C.

(57) ABSTRACT

The invention relates to a lacing system (2) for a shoe (1), in particular for an inner shoe, with a cord-type or lace-type tensioning means (12) and looping means (11) for the tensioning means (12) arranged on oppositely lying wall regions (8, 9) of a shoe cut-out (5) extending from an entry opening (3) approximately to as far as an ankle region (4) and having at least one fixing means (18) for the tensioning means (12). In a first tensioning region (13) extending across the ankle region (4), the looping means (11) are arranged more or less opposite one another and in another tensioning region (14) extending in the direction towards the entry opening (3), the looping means (11) are arranged offset in height from one another on the oppositely lying wall regions (8, 9) and the tensioning means (12) in the first tensioning region (13) forms a tensioning loop (32) zigzaging over the shoe cut-out (5), from which a tensioning means cord (30) spanning the shoe cut-out (5) in a zigzag pattern between the looping means (11) forms the other tensioning region (14), and an end region (19) of the tensioning means cord (30) is joined to the shoe (1) by means of the fixing device (18) disposed in the region of the entry opening (3) in a clamped and/or releasable arrangement.

11 Claims, 2 Drawing Sheets

LACING SYSTEM FOR A SHOE

BACKGROUND OF THE INVENTION

1. Field of the Invention

The invention relates to a lacing system for a shoe, in particular an inner shoe, with a cord-type or lace-type tensioning means and looping means for the tensioning means disposed on oppositely lying wall regions of a cut-out in the shoe extending from an entry opening to approximately as far as an ankle region, and having at least one fixing means for the tensioning means.

2. The Prior Art

Patent specification EP 0 398 303 A2 discloses a clamping device for a lacing system of a shoe, in which different looping mean wall regions of a shoe cut-out and the shoe lace spans the shoe cut-out in a crossing arrangement between the looping means. During lacing, looping eyelets are provided so that the shoe lace can be threaded through freely. The looping means are provided in the form of tightening eyelets specifically in a transition region between an ankle region and the leg region and in the region of an entry opening, which is intended to facilitate lacing, so that a different tensioning of the lace can be obtained in these regions. However, it is still necessary to use two hands to tie a knot in the two cords of the shoe lace.

SUMMARY OF THE INVENTION

The objective of the invention is to propose a lacing system for a shoe, by means of which a shoe cut-out adjoining an entry opening can be changed from a widened position, obtained by a simple lacing procedure intended to facilitate entry, into a closed position enclosing a foot of a user in the shoe.

This objective is achieved by the invention due to the fact that in a first tensioning region extending across the ankle region, the looping means lie more or less opposite one another and in another tensioning region extending in the direction towards the entry opening, the looping means are offset from one another in height on the wall regions, and the tensioning means in the first tensioning region forms a tensioning loop transversely spanning the shoe cut-out in a zigzag pattern between the looping means, of which a tensioning means cord spanning the shoe cut-out in a zigzag pattern between the looping means forms the other the other tensioning region and one end of the tensioning means cord is joined to the shoe by means of the fixing device in the region of the entry opening in a clamped and/or releasable arrangement. The surprising advantage of this approach is that tensioning forces can be uniformly distributed over a longer length of a shoe cut-out and tightening and loosening can be effected very rapidly and using one hand only.

Another advantageous design of the lacing system is one in which a threading loop is provided on another end of the tensioning element, through which the tensioning means cord extends from the ankle region to the other tensioning region, as a result of which the lacing force is uniformly distributed between the two tensioning regions.

Another embodiment is also possible in which the end region of the tensioning means provided with the threading loop is disposed between the first tensioning region and the other tensioning region, the advantage of which is that it results in bending elasticity to permit movement of the joints in the transition region.

In one possible embodiment of the lacing system, the looping means are provided in the form of tape loops on the shoe, e.g. made from textile or plastic strips, thus resulting in a design that is technically simple and inexpensive to produce.

The fact that the looping mean are plastic injection-moulded parts makes insertion of the tensioning means particularly easy and is gentler on the looped areas.

The fact that the fixing means may be provided in the form of an interlocking tape system with a strip of interlocking tape attached to the tensioning means cord and a strip of interlocking base tape on the shoe, or a lever and clasp system, or a toothed belt and clasp system means that a plurality of functionally proven fixing means is available which have proven themselves in practice as a means of maintaining tensioning forces constant in order to fix a foot in a shoe.

In another possible embodiment of the lacing system, the looping means in the wall region lying opposite the fixing means is provided in the form of an anti-backsliding element for the tensioning means cord because the tension forces of the tensioning means intended to maintain the tension are transmitted to two oppositely lying points of the shoe in the region of the entry opening.

The fact that the anti-backsliding element for looping the tension means has a free-running region and a clamping region adjoining it means that the tensioning means can be simply moved away from the direction of tension in the direction towards the fixing means in order to clamp it, without requiring any other technical devices, thereby preventing any backsliding of the tension means which might otherwise loosen the clamping effect.

Finally, advantages are to be had from another embodiment of the lacing system in which the anti-backsliding element is provided in the form of a loop clamping eyelet, because strong retaining forces can be achieved for tensioning purposes and the demands placed on the fixing means in terms of securing the tensioning force are reduced and enable simple designs to be used.

BRIEF DESCRIPTION OF THE DRAWINGS

In order to provide a clearer understanding, the invention will be explained in more detail with reference to examples of embodiments illustrated in the appended drawings. Of these.

DETAILED DESCRIPTION OF PREFERRED EMBODIMENTS

Figure 1:
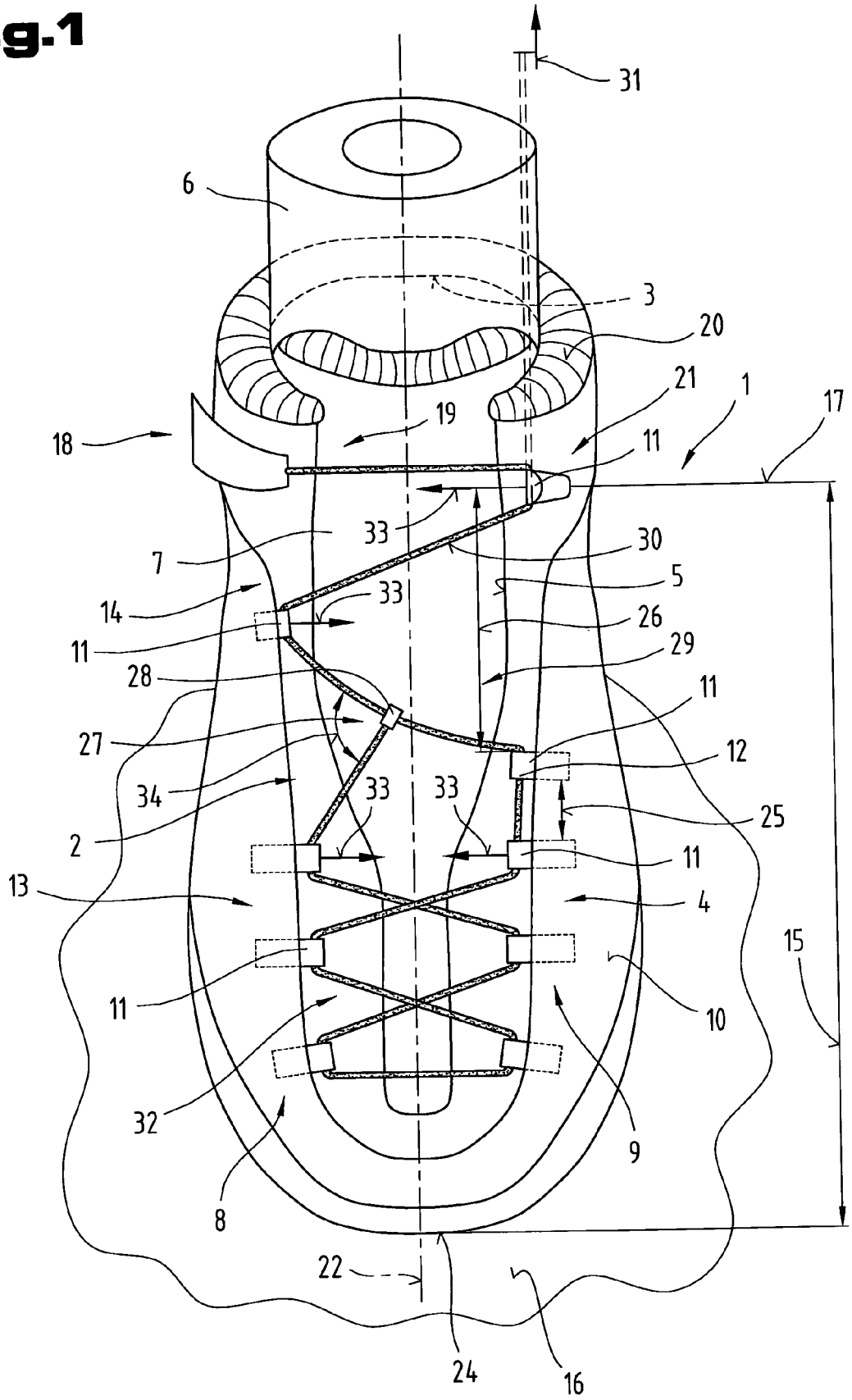
FIG. 1 is a view showing a shoe with the lacing system proposed by the invention.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc, relate to the drawing specifically being described and can be transposed in terms of meaning to a new position when another position is being described. Individual features or combinations of features from the different embodiments illustrated and described may be construed as independent inventive solutions or solutions proposed by the invention in their own right.

FIG. 1 illustrates a shoe 1 with a lacing system 2 for a shoe cut-out 5 extending from an entry opening 3 as far as an ankle region 4.

A shoe 1 of this type might be a lightweight shoe for sporting activities, in particular a soft boot or an inner shoe which can be inserted inside a plastic shoe shell, such as might be used as ski shoes or roller shoes.

The shoe cut-out 5 in this type of embodiment usually has a tongue 7 extending behind it in order to distribute the tightening forces of the lacing system 2 uniformly and provide cushioning for a foot 6.

Depending on the intended purpose of the shoe 1, different materials and combinations of materials may be used to accommodate the foot 6 in comfort and provide the correct hygiene conditions, whilst imparting stiffness to those regions which need it. Accordingly, various textile fabrics combined with plastics, foam padding and leather may be used, for example, as is standard practice for shoes 1 of this type.

As may be seen from FIG. 1, looping means 11 are attached to an external surface 10 of the shoe 1 on oppositely lying wall regions 8, 9 of the shoe cut-out 5 for slidingly inserting a cord-type or lace-type tensioning means 12.

Looping means 11 of this type are generally known from the prior art and might be textile strap loops, plastic eyelets, looping hooks of metal or plastic or ring eyelets, for example.

The tensioning means 12 is a lace or cord made from textile or metal materials or a plastic cord, preferably with a round cross section, although it would also be possible to use a flat strip.

Due to the special layout of the looping means 11 along the wall regions 8, 9 proposed by the invention, two distinctive tensioning regions 13, 14 span the shoe cut-out 5, the first of which tensioning regions essentially comprises the ankle region 4, whilst the other tensioning region 14 extends as far as the entry opening 3.

In tensioning region 13 spanning the ankle region 4, the looping means 11 are attached to the wall regions 8, 9 of the shoe cut-out 5 and lie opposite one another, whilst in the other tensioning region 14 they are positioned offset in height from one another and the last looping means 11 in the series disposed in the region of the entry opening 3 has a fixing means 18 on the oppositely lying wall region at approximately the same height 15 and extending in a plane parallel with the support surface 16 used to secure the tensioning means 12 in a clamped and releasable arrangement in an end region 19 on the shoe 1. This fixing means 18 is preferably disposed on the shoe at an outer side of the foot 6 and is formed by a strip of interlocking tape joined to the tensioning means 12, which can be joined to a strip of interlocking base tape attached to the shoe 1.

It is also of advantage to provide the looping means 11 directly in a peripheral region 20 of the entry opening 3 as an anti-backsliding element 21, so that when the tensioning means 12 has been looped in the direction towards the fixing means 18, the tensioning means 12 is secured to prevent it from unintentionally sliding back, thereby relieving strain on the fixing means 18.

In the preferred embodiment illustrated as an example here, three pairs of looping means 11 are provided in the ankle region 4, spaced at a distance apart from one another in the longitudinal direction relative to an imaginary central line 22 of the shoe cut-out 5, the individual looping means 11 of the pairs being disposed opposite one another and attached to the wall regions 8, 9. Because the tensioning means 12 are looped through the looping means 11 and zigzag over the shoe cut-out 5 in the ankle region 4 and hence the tightening region 13, tensioning forces are generated in the direction more or less perpendicular to the central line 22 when the tensioning means 12 is tightened, so that the foot 6 is fixed in the ankle region 4 in the shoe. The looping 11 means of the ankle region 4 that is spaced the farthest apart from the shoe tip 24, preferably on a corresponding wall region 9 on a foot outer side, is disposed at a shorter distance 25 from another looping means 11. In order to guide the tensioning means 12 in the described zigzag arrangement in the other tightening region 14 as far as the fixing means 18, this looping means 11 has another looping means 11 lying opposite it on the oppositely lying wall region 8 more or less on a level with the centre of a distance 26 left free before the looping means 11 which lies opposite the fixing means 18.

The tensioning means 12 then extends in the ankle region 3 in the form of a loop, transversely crossing the shoe cut-out 5 twice between the looping means 11, for which purpose an end region 27 of the tensioning means 12 has a threading loop 28 through which the tensioning means 12 extends in a transition region 29 between the tightening regions 13, 14, which forms a tensioning means cord 30 in tensioning region 14 adjoining tensioning region 13 as far as the entry 3 opening in order to fix the foot 6 in the shoe 1.

Before fixing the tensioning means cord 30 on the fixing means 18, if a lacing force is applied more or less parallel with the course of the centre line 22—in the direction of arrow 31—as indicated by broken lines, the shoe cut-out 5 is uniformly closed and encloses the foot 6 in the ankle region 4 due to the action of a tensioning loop 32 obtained by guiding the tensioning cord 30 through the loop 28 and as a result of the tensioning forces in the rest of the shoe cut-out 5, directed more or less perpendicular to the centre line 22—indicated by arrow 33. The tensioning forces—indicated by arrow 33—are maintained by the clamping effect in the anti-backsliding element 21 when the tensioning means cord 30 is looped away from the direction of tension towards the fixing means 18, in which it is secured.

The best tensioning of the tensioning loop 32 in the ankle region 4 is obtained if the path of the tensioning means 12 or an angle 34 between the end region 27 incorporating the loop 28 and the tensioning means cord 30 is between 60° and 120°, preferably approximately 90°.

Figure 2:
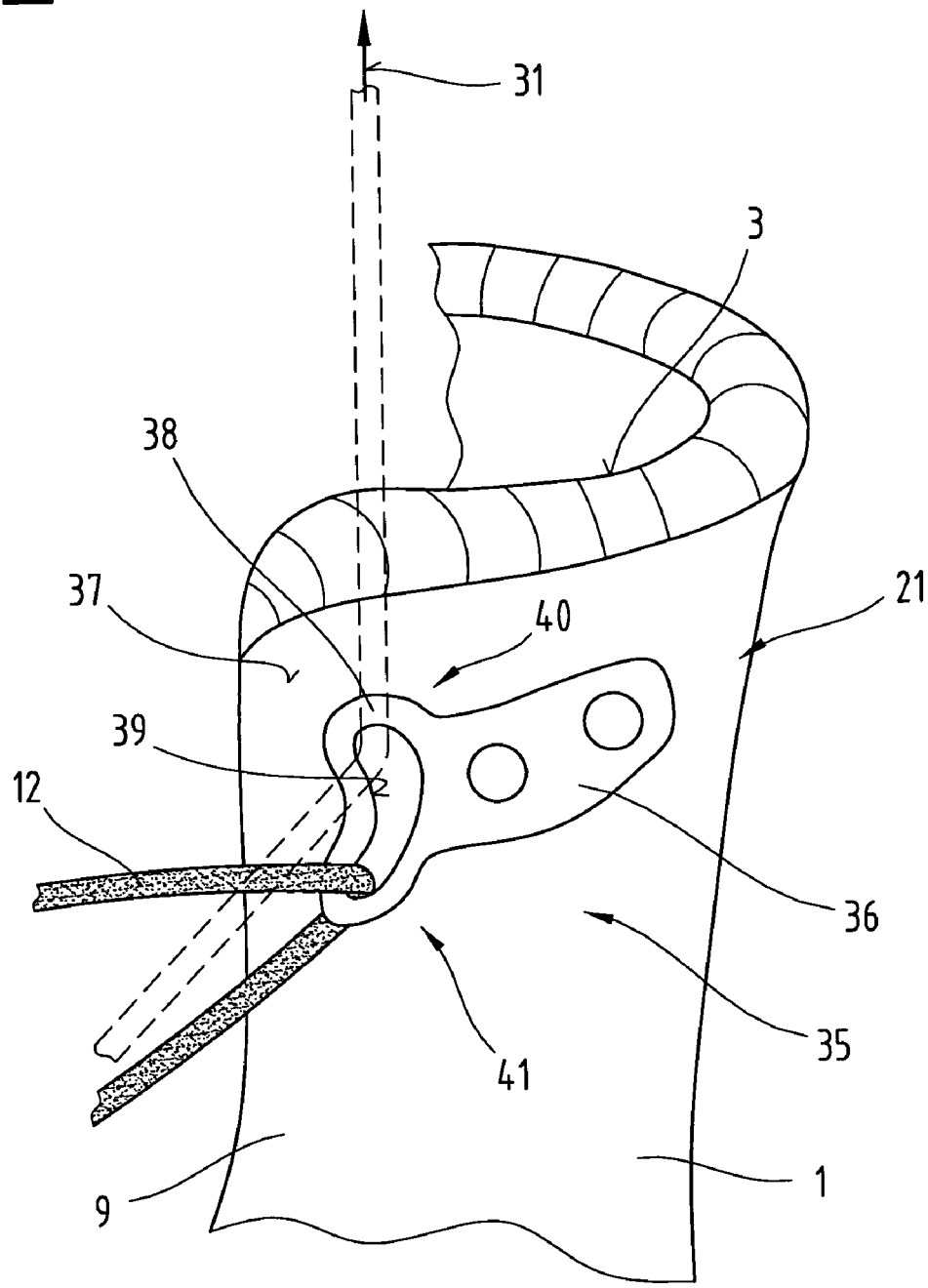
FIG. 2 shows a part region of the shoe with an anti-backsliding element.

FIG. 2 illustrates one possible embodiment of the anti-backsliding element 21 disposed in the peripheral region 20. It has a rivet tab 36 which can be attached to the wall region 9 of the shoe 1, for example. A ring eyelet 38 spaced apart from a surface 37 of the wall region 9 by an offset has a kidney-shaped orifice 39 through which the tensioning element 12 is looped. This design of the orifice 39 forms a larger free-running region 40 matching the cross section of the tensioning means and a clamping region 41 which is smaller in size than a cross section of the tensioning means 12. As the lacing force is being applied—in the direction of arrow 31—indicated by broken lines, the tensioning means 12 is disposed in the free-running region 40, so that tightening can proceed unhindered. If the tensioning means 12 is moved in the direction towards the oppositely fixing means, not illustrated, in conjunction with a simultaneous downwards movement, the clamping action of the clamping region 41 comes into play, preventing any unintentional backsliding of the tensioning means and thus effectively preventing the lacing from working loose, whilst simultaneously relieving stress on the fixing means.

Naturally, it would also be conceivable to use a series of various other embodiments for an anti-backsliding element 21 of this type, such as a looping hook system, in which the inner region of the hook is provided with the free-running region in the pulling direction so that when the tensioning means is looped across, it moves into the looping cross section with the smaller dimension, which will effectively prevent the tensioning means from backsliding.

It is of advantage to use anti-backsliding elements 21 of this type for designs where the tensioning means can be fixed using one hand only.

It should also be pointed that, as illustrated in FIG. 1, different embodiments may also be used for the fixing means 18, and are known from the prior art, including for example an interlocking tape system 42 with a strip of interlocking base tape attached to the shoe 1 and a strip of interlocking tape 44 attached to the tensioning means cord 30, as illustrated, but it would naturally also be possible to use known buckle systems, tooth systems with toothed belts-clamping buckles, etc.

The examples of embodiments illustrate possible design variants of the lacing system but it should be pointed out that the invention is not restricted to the particular embodiments illustrated here. It would also be possible to use various combinations of the individual design variants based on the teaching of the invention and these would be well within the reach of the person skilled in this field. Accordingly, all conceivable variants would be possible using combinations of individual details taken from the embodiments described and illustrated, without departing from the scope of the invention.

For the sake of good it order, finally, it should be pointed out that in order to provide a clearer understanding of the lacing system, it and its constituent parts are illustrated to a certain extent out of proportion and/or on an enlarged scale and/or on a reduced scale.

The objective underlying the individual solutions proposed by the invention may be found in the description.

Above all, the individual embodiments of the subject matter illustrated in FIGS. 1; 2 may be construed as independent solutions proposed by the invention in their own right. The objectives and associated solutions may be found in the detailed descriptions of these drawings.

What is claimed is:

1. Lacing system for a shoe, in particular an inner shoe, with a cord-type tensioning means and looping means for the tensioning means arranged on oppositely lying wall regions of a shoe cut-out extending from an entry opening approximately to as far as an ankle region and having at least one fixing means for the tensioning means, wherein in a first tensioning region extending across the ankle region, the looping means are arranged more or less opposite one another and in another tensioning region extending in the direction towards the entry opening, the looping means are arranged offset in height from one another on the oppositely lying wall regions, and the tensioning means in the first tensioning region forms a tensioning loop zigzaging over the shoe cut-out, from which a tensioning means cord spanning the shoe cut-out in a zigzag pattern between the looping means from the other tensioning region and the end region of the tensioning means cord is joined to the shoe by means of the fixing means disposed in the region of the entry opening in a clamped and/or releasable arrangement.

2. Lacing system according to claim 1, wherein a threading loop is provided on another end region of the tensioning means, through which the tensioning means cord extends from the ankle region to the other tensioning region.

3. Lacing system according to claim 2, wherein the end region of the tensioning means provided with the threading loop is disposed between the first tensioning region and the other tensioning region.

4. Lacing system according to claim 1, wherein the looping means are provided in the form of tape loops attached to the shoe.

5. Lacing system according to claim 1, wherein the looping means are plastic injection-moulded parts.

6. Lacing system according to claim 1, wherein the fixing means is an interlocking tape arrangement with an interlocking tape attached to the tensioning means cord and a strip of interlocking base tape disposed on the shoe.

7. Lacing system according to claim 1, wherein the fixing means is a lever and clasp system.

8. Lacing system according to claim 1, wherein the fixing means is a toothed belt and clasp system.

9. Lacing system according to claim 1, wherein the looping means provided in the wall region lying opposite the fixing mean is an anti-backsliding element for the tensioning means cord.

10. Lacing system according to claim 9, wherein the anti-backsliding element has a free-running region for looping the tensioning means and a clamping region adjoining it.

11. Lacing system according to claim 9, wherein the anti-backsliding element is a looping eyelet.

* * * * *